US005556739A

United States Patent [19]

Nakanishi et al.

[11] Patent Number: 5,556,739

[45] Date of Patent: Sep. 17, 1996

[54] PHOTOGRAPHIC SUPPORT

[75] Inventors: Kenji Nakanishi; Takatoshi Yajima; Hiromitsu Araki; Hideyuki Kobayashi, all of Hino; Yoshioki Ohkubo; Tetsutaro Hashimura, both of Hofu; Hiroshi Naito, Yamaguchi, all of Japan

[73] Assignee: Konica Corporation, Japan

[21] Appl. No.: 214,962

[22] Filed: Mar. 14, 1994

[30] Foreign Application Priority Data

Mar. 30, 1993 [JP] Japan ..... 5-072476

[51] Int. Cl.[6] ..... G03C 1/795; G03C 1/93

[52] U.S. Cl. ..... 430/533; 430/534

[58] Field of Search ..... 430/533, 534

[56] References Cited

U.S. PATENT DOCUMENTS 5,071,736 12/1991 Ikenoue et al. ..... 430/533

5,360,708 11/1994 Takada et al. ..... 430/533

FOREIGN PATENT DOCUMENTS 275801 7/1988 European Pat. Off. .

64442 2/1992 Japan .

8558 9/1989 WIPO .

*Primary Examiner*—John S. Y. Chu

*Attorney, Agent, or Firm*—Jordan B. Bierman; Bierman and Muserlian

[57] ABSTRACT

A support for photographic use comprised of at least two polyester layers is disclosed, which comprises a first layer containing a first polyester and a second layer containing a second polyester adjacent to the first layer, the first polyester comprising a first monomer unit from a polyalkylene glycol and a second monomer unit from an aromatic dicarboxylic acid having a metal sulfonate group, wherein the difference between the second monomer unit content of the first polyester and that of the second polyester, ΔSIP is not more than 5.5 mol %, the second monomer unit content being expressed based on the total content of monomer units from dicarboxylic acids contained in the polymer.

9 Claims, 1 Drawing Sheet

PHOTOGRAPHIC SUPPORT

FIELD OF THE INVENTION

The present invention relates to a support for photographic use, and more particularly, to a support for photographic use comprised of laminated polyester films wherein the curl-recovery property after being subjected to photographic processing is excellent, curling property after photographic light-sensitive emulsion layers have been formed has been improved and adhesive property between each of the polyester layers at a extremely low temperature is also excellent.

BACKGROUND OF THE INVENTION

Recently, the applications of photographic light-sensitive materials have been devirsified. For example, in compatibility with miniaturizing of photo taking units, it is known that light-sensitive materials with a thinner support for photographic use are effective. However, in the case of a thinner support for photographic use, so-called stiffness is weakened. Accordingly, there are problems that transportation property and operability in a photo taking unit and developing processes become deteriorated. In order to solve the above-mentioned problems, it is necessary to enhance mechanical strength of a support for photographic use. Especially, the value of elastic module is necessary to be enhanced than that of the conventional support.

Typical plastic film supports currently used are triacetyl cellulose (sometimes abbreviated as TAC) and polyethylene terephthalate (sometimes abbreviated as PET).

A TAC film used for a film in roll mainly has a property to have a high transparency without optical aeolotropicity and also has an excellent property that curling is recovered after being developed. However, since the TAC film has a drawback that the mechanical strength is weak in itself, it cannot reduce the thickness thereof.

On the other hand, a PET film has an excellent mechanical strength and size stability. Therefore, it is used in a sheet form film such as a film for X-ray film use. However, when the PET film is used in a roll film form which is widely used as a photographic light-sensitive material, it is difficult to recover curling after being developed and it is poor in handling property. Accordingly, the range of application is limited.

As a technology to improve curl recovering property of the PET film, a copolymer PET film provided with hydrophilicity by using an aromatic dicarboxyl acid having a metallic sulfonate group as a copolymerization component (see Japanese Patent Publication Open to Public Inspection (hereinafter referred to as Japanese Patent O.P.I. Publication) No. 244446/1989). However, when a photographic light-sensitive material is prepared using the polyester film obtained in the above-mentioned manner, photographic emulsion layers are formed on one side of the support. Since elasticity of these emulsion layers in accordance with the change of temperature is larger as compared to that of the support, concave curling occurs on the emulsion layer surface when it is left under low humidity after having been subjected to development. Accordingly, operability after subjected development is reduced.

In order to solve the above-mentioned problems, there are several means for providing anti-curling property such as to laminate polyester layers having different specific viscosities, to heat at different temperatures to the two top and bottom surfaces during vertical stretching or heat setting when a support is manufactured and to permeate the support with an organic solvent such as toluene, phenol or hexane on only one side and evaporate the above-mentioned solvent by heating.

On the other hand, when a film disclosed in Japanese Patent O.P.I. Publication No. 235036/1992 wherein a copolymerization polyester having an aromatic dicarboxylic acid having a metallic sulfonate group and a polyalkylene glycol as the main copolymerization components and a polyester including PET mainly are laminated, adhesive property between the polyester layer and the copolymerization polyester layer is poor. When such films are used at extremely low temperatures, for example, below the freezing point, the polyester layer and the copolymer polyester layer are liable to be separated at their interface.

In order to solve the above-mentioned problems, there exists a technology to use two adjacent polyester layers which are similar in chemical composition or a technology to incorporate the polyester component contained in one layer into the other layer. Thus, the polyester support which is similar in the composition of two adjacent polyester layers is obtained, however, the present inventors have discovered that, when there is a large difference between the composition of the two adjacent polyester layers, sufficient adhesion at a low temperature cannot be obtained.

SUMMARY OF THE INVENTION

Figure 1:
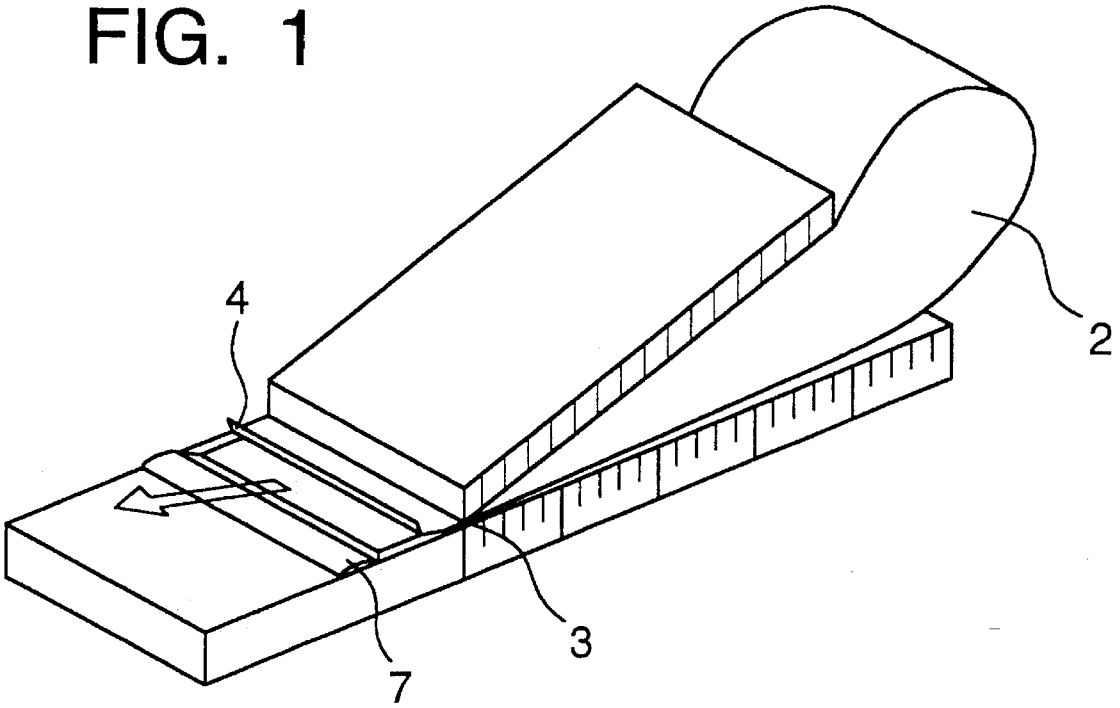
FIG. 1 is a perspective view showing a wedge type tester for measuring an adhesive property.

An object of the invention is to provide a support for photographic use comprised of laminated polyester films, wherein a curl-recovery property after photographic processing is excellent, an anti-curling property, after coating with a photographic light-sensitive emulsion layer on the support, is improved and the adhesive property between the polyester films at an extremely low temperature is excellent.

The above objects have been attained by a support for photographic use comprised of at least two polyester layers comprising a first layer containing a first polyester and a second layer containing a second polyester adjacent to the first layer, the first polyester comprising a first monomer unit from a polyalkylene glycol and a second monomer unit from an aromatic dicarboxylic acid having a metal sulfonate group as a copolymerization component, wherein the difference between the second monomer unit content of the first polyester and that of the second polyester, ΔSIP is not more than 5.5 mol %, the second monomer unit content being expressed based on the total content of the monomer units from dicarboxylic acids contained in the polyester.

DETAILED DESCRIPTION OF THE INVENTION

Hereunder, the present invention will be explained in detail.

The support for photographic use of the present invention is a multilayer film wherein two or more layers composed of a polyester are laminated. Arbitrary two adjacent layers in the aforesaid multilayer of the polyester have a composition different from each other.

In the present invention, the polyesters having a different composition refers to be polyesters whose main structural components or copolymerization components are different from each other or the contents thereof are different when the main structural components and the copolymerized components are the same.

The polyester used in at least one layer of the support according to the present invention is a copolymerization polyester (hereinafter referred to as the polyester of the invention) containing as main structural components a monomer unit from an aromatic dibasic acid and a monomer unit from a glycol, and further containing as a copolymerization component a monomer unit from an aromatic dicarboxylic acid having a metallic sulfonate group.

As the aromatic dibasic acid, terephthalic acid, isophthalic acid, and naphthalene dicarboxylic acid are cited. As the glycol, ethylene glycol, propylene glycol, butanediol, neopentyl glycol, 1,4-cyclohexane dimethanol, diethylene glycol, and p-xylylene glycol are cited. As the naphthalene dicarboxylic acid, naphthalene dicarboxylic acid are cited. Of them, the preferable is a 2,6-naphthalene dicarboxylic acid is cited. In the present invention, a copolymer polyethylene terephthalate whose main structural component is terephthalic acid and ethylene glycol is preferable.

As the aromatic dicarboxylic acid having a metallic sulfonate group, 5-sodium sulfo isophthalic aicd, 2-sodium sulfo isophthalic acid, 4-sodium sulfo isophthalic acid and 4-sodium sulfo-2,6-naphthalene dicarboxylic acid or ester derivatives thereof and compounds wherein these sodiums are substituted with other metals, for example, potassium and lithium are used.

The content of the aromatic dicarboxylic acid having a metallic sulfonate group is preferably 2 to 7 mol % on the total ester bond unit in order to obtain sufficient curl-recovery property and mechanical strength.

The polyester of the invention may contain polyalkylene glycols as a copolymerization component. This polyalkylene glycols added are preferably 3 to 10 weight % and more preferably 4 to 8 weight % on the total weight of the polyester in order to obtain sufficient curl-recovery property and mechanical strength.

As the polyalkylene glocol, polyethylene glycol, polytetramethylene glycol and its derivatives are used. Polyethylene glycol represented by the following Formula (a) is preferable.

Formula (a)

$$H—(O—CH_2CH_2)_n—OH$$

As the polyalkylene glycol, a polyethyleneoxy dicarboxylic acid represented by Formula (b) wherein —H located at the end of the polyethylene glycol is substituted by —$CH_2COOR$ (provided that R represents a hydrogen atom or an alkyl group having 1 to 10 carbons) and a polyeter dicarboxylic acid represented by Formula (c) (provided that R' represents an alkylene group having 2 to 10 carbons) can offer the same effect.

Formula (b)

$$ROOCCH_2—(O—CH_2CH_2)_n—OCH_2COOR$$

Formula (c)

$$ROOCCH_2—(O—R')_n—OCH_2COOR$$

Though there is no limitation to a number average molecular weight of the polyalkylene glycols, it is preferable to be 300 to 20,000, more preferable to be 600 to 10,000 and especially more preferable to be 1,000 to 5,000.

In the polyester of the invention, a saturated aliphatic dicarboxylic acid may be further incorporated as a copolymerization component. The amount is preferably 3 to 25 mol % and more preferably 5 to 20 mol % on the total ester bond.

As the saturated aliphatic dicarboxylic acid, succinic acid, glutalic acid and adipic acid are cited. The preferable is adipic acid.

In the polyester of the invention, other components may be copolymerized additionally and other polymers may be blended as far as they do not hinder the effect of the present invention.

As the polyester other than the above-mentioned polyester of the invention which constitutes the support of the present invention, the polyester whose main structural components are an aromatic dibasic acid and glycol is cited. As the aromatic dibasic acid, terephthalic acid, isophthalic acid and a naphthalene dicarboxyl acid are cited. As a glycol, ethylene glycol, propyrene glycol, butanediol, neopentyl glycol, 1,4-cyclohexane dimethanol, diethylene glycol, and p-xylene glycol are cited. As the naphthalene dicarboxylic acid 2,6-naphthalene dicarboxylic acid is preferably cited. In the present invention, a polyethylene terephthalate whose main components are terephthalic acid and ethylene glycol is preferable.

The support of the present invention can improve adhesive property between two arbitrary adjacent layers of the support by adjusting the composition of the two layers in a specific composition.

In the present invention, in order to improve adhesive property of two arbitrary adjacent layers in the layers which constitute the support, the above described ΔSIP is not more than 5.5 mol %, preferably not more than 4.5 mol %, and more preferably not more than 1 to 4.5 mol %. It is preferable in the support of the invention that the above described ΔPEG is not more than 6.0% by weight. The ΔPEG is preferably not more than 5% by weight and more preferably, not more than 3 to 5% by weight.

It is preferable that ΔSIP and ΔPEG are not 0 concurrently.

Any number of layers which constitute the support for photographic use of the present invention may be allowed. However, in order to simplify the manufacturing facility thereof, it is ordinarily preferred to be two or three layers. In the case of two layers, they comprise at least one layer containing the polyester of the invention, a laminated layer of a polyester layer and a layer containing the polyester of the invention, or a laminated layer containing the polyester of the invention having a different composition. In the case of three layers, they comprise at least one layer containing the polyester of the invention. In the case of polyester layers wherein arbitrary adjacent two layers have different composition, any order in the lamination of the polyester layers which constitute the support of the invention may be allowed.

At least one of two adjacent layers of the support of the present invention preferably contains 1 to 40 weight % of the main polyester component of the other layer.

To a polyester and the polyester of the present invention, various additives can be incorporated. For example, in order to prevent "light piping phenomenon" (also referred to as "fringe fogging) which occurs when a light is incidenced from an edge to a film wherein photographic emulsion layers are formed, dyes can be added to the film. There is no limitation to dyes added to the film. However, for example, anthraquinone type chemical dyes are cited, because they are desirable in terms of heat-durability in the course of forming the polyester film. In addition, with regard to the color tone of the film, gray dyes as used in ordinary light-sensitive materials are preferable. One or two or more dyes may be mixed to be used. The target can be attianed by the use of dyes such as Diaresin produced by Mitsubishi Kasei Co., Ltd. and MACROLEX produced by Bayer independently or in combination.

In addition, to a polyester and the polyester of the present invention, other additives conventionally used such as a matting agent, an anti-static agent, a surfactant, a stabilizer, a dispersant, a plasticizer, a UV absorber, an electroconductive material, a viscosity-providing agent, a softening agent, a fluidity-providing agent, a viscosity-enhancing agent and an anti-oxidation agent may be added so far as not hindering the effects of the present invention.

In addition, to a polyester and the polyester of the present invention, in the stage of polymerization, phosphoric acid, phosphorous acid and their esters and inorganic grains such as silica, caoline, calsium carbonate, calcium phosphate and titanium dioxide may be added. After polymerization, inorganic grains may be blended.

The polymerization of the polyester of the present invention is not limited in terms of its manufacturing method. For example, when a copolymerization reaction is carried out after ester exchanging reaction, copolymerization components such as an aromatic dicarboxyl acids having a metallic sulfonate group and polyethylene glycol may be added during the ester exchaging reaction and condensation copolymerization may be continued. The condensation copolymerization may be conducted after adding the above-mentioned copolymerization components after ester exchainging reaction. In addition, if necessary, the resulting polyester may be subjected to bulk copolymerization so that the specific viscosity may be enhanced.

In order to provide an anti-curl property, polyesters having different thickness, component and specific viscosity are preferably laminated in the both outer layers of the support for photographic use of the present invention.

The curl-recovery property of the entire support for photographic use of the present invention becomes desirable by laminating at least one polyester layer containing a copolymer polyester affluent in hydrophilic property and excellent in curl-recovery property.

Any thickness of the support for photographic use of the present invention is allowed as far as necessary strength can be obtained depending upon the application. In order to obtain a thickness and strength having superiority to the conventional supports, from 30 to 200 μm, and more preferably, 40 to 120 μm the thickness is preferably. In the present invention, it is allowable to enhance the number of laminated film as in 4 layers or 5 layers. The thickness of each layer constituting a multilayer film may be different or the same. The thickness of layers constituting the support for photographic use of the present invention is not less than 2 μm, provided that a subbing layer thereon is not present.

The ratio $T_A/T_B$ in two adjacent layers A and B in the support of the invention is preferably 0.7 to 3, and more preferably, 1 to 2 in terms of an curling property, wherein $T_A$ is a thickness of layer A and $T_B$ is a thickness of layer B, with layer A containing a larger PEG component than layer B.

The support for photographic use of the invention can be manufactured by a co-extrusion method wherein, after polyester and copolymer polyester are subjected to melt extruding from an extruder, they are joined inside a feeding pipe of a molten polymer or inside an extrusion head in a laminar form for extrusion, they are cooled and solidified on a cooling drum for obtaining an unoriented film and they are subjected to biaxial orientation and heat setting, or by an extrusion laminating method wherein polyester or a copolymer polyester is independently or laminatedly subjected to melt extrusion from the extruder, an anchor agent and an adhesive agent are coated if necessary on an unoriented film cooled and solidified on a cooling drum or a monoaxially-oriented film wherein aforesaid unoriented film is subjected to monoaxial orienting, either of aforesaid film are provided thereon with polyester or a copolymer polyester by an extrusion lamination and, finally, subjecting to heat setting after biaxial orientation in a vertical direction is completed. Of them, due to simplicity of process, the co-extrusion method is preferable.

There is no limitation to a method to biaxially orient the resulting sheet. However, any of the following methods (A) through (D) can be adopted. In order to satisfy the mechanical strength and dimension stability of the film support, orientation magnification is preferred to be 4 to 16 times in terms of area ratio.

(A) A method of stretching an unoriented film in the longitudinal direction first and then stretching it in the lateral direction.

(B) A method of stretching an unoriented film in the lateral direction first and then stretching it in the longitudinal direction.

(C) A method of stretching an unoriented film in the longitudinal direction in a single step or multiple steps, stretching again in the longitudinal direction and then stretching it in the lateral direction.

(D) A method of stretching an unoriented film in the longitudinal direction in a single step or multiple steps, stretching in the lateral direction, stretching again in the longitudinal direction and then stretching it in the lateral direction.

There is no limitation to the temperature of stretching. However, it is ordinarily preferred to adjust in accordance with the conditions of polyester layer. It is preferred to conduct stretching in a biaxial direction under the stretching magnification of 2.5 to 6.0 times at a temperature range from a glass transition temperature (Tg), which is higher of Tg of the copolymer polyester and polyester used to Tg+100° C. In addition, the heat setting temperature is preferred to be 50° C. to 240° C.

The support for photographic use of the present invention is applicable to various application known so far. Of them, it is especially useful for a support for photographic use used for a roll type film.

The silver halide photographic light-sensitive material is so structured by a support for photographic use of the present invention provided thereon with at least one silver halide emulsion layer on at least one side of the support.

At least one silver halide emulsion layers may be provided on one side of the support, or on both side of the support respectively. Such silver halide emulsion layers may be formed on a polyester film support, directly, or via another layer such as a hydrophilic colloid layer containing no silver halide emulsion. Further, there may also be provided a hydrophilic colloid layer as protective layer on the silver halide emulsion layers. These silver halide emulsion layers may be formed in different sensitivities; for example, these may be divided into a high speed emulsion layer and a low-speed emulsion layer. In this case, an intermediate layer may be provided between these emulsion layers; that is, an intermediate layer comprising hydrophilic colloid may be provided when necessary. In addition, there may also be provided, between a silver halide emulsion layer and a protective layer, a nonlight-sensitive hydrophilic colloid layer such as an intermediate layer, a protective layer, an antihalation layer or a backing layer.

Silver halides used in these silver halide emulsions may have any composition. Examples of usable silver halides include silver chloride, silver chlorobromide, silver chloroiodobromide, pure silver bromide and silver iodobromide. Further, these silver halide emulsions may contain other components such as sensitizing dyes, plasticizers, antistatic agents, surfactants and hardeners.

The silver halide photographic light-sensitive material of the invention can be developed by use of conventional developers described, for example, in T. H James, The Theory of the Photographic Process, Forth Edition, pp. 291–334 and Journal of the American Chemical Society, vol. 73, p. 3,100 (1951).

EXAMPLES

Hereunder, examples of the present invention will be explained practically.

The measurement method of each property value in the following Examples are shown below.

<Curl recovery property>

A multilayer color photographic light-sensitive material with a size of 12 cm×35 mm was wound on a winding core with a diameter of 10 mm and left for 3 days at a temperature of 55° C. and 40% RH to cause curling. After that the sample was unwound from the winding core and immersed in pure water at 38° C. for 15 minutes. Then, the sample was loaded with 50 g, hungvertically and dried for 3 minutes by means of a heated air drier at 55° C. After releasing the load, the sample was being suspended naturally. The vertical length of the suspended sample was measured and the ratio of the thus measured length to the original length (12 cm) was expressed in percent. Practically, it is preferred that the curl recovery property is larger than 50%.

<Adhesive property>

Adhesive property was measured using a wedge-type tester at −10° C. With an emulsion surface facing outside, one of the edges of a film having a width of 35 mm and a length of 25 cm was clipped by clip portion 1. The film was looped at portion 2. The other edge of the film was taken outside the wedge through slit portion 3. Holding portion 4, the film was quickly pulled rushly parallel to the scale. Since film having a weak adhesive property between adjacent layers causes separation, the adhesive property was evaluated on whether or not separation occurred. Table 1 shows the results. In Table 1, O represents a sample wherein separation did not occur and X represents a sample wherein separation occurred.

<Curling property>

After a multilayer color photographic light-sensitive material described later was subjected to photographic processing, it was cut to 35 mm×1 mm to obtain a sample. After the sample was left for 36 hours under the relative humidity of 20% RH, the degree of curling (Unit: 1/m) was measured. Curling on the emulsion layer side was defined to be plus, and curling on the opposite side was defined to be minus. The sample was evaluated according to the following standards. Table 1 shows the results. In Table 1, samples having a curling degree of −20 or more and +20 or less are marked with O. Samples having a curling degree of −40 or more, and less than −20, or more than +20 and +40 or less are marked with Δ. Samples having a curling degree of less than −40 or larger than +40 are marked with X.

<Measurement method of copolymerization components>

The values were obtained by $^1$H-NMR measurement at a temperature of 40° C. using a mixed solvent wherein the ratio of $CDCl_3$ and $CF_3COOH$ is 1:1 by means of CX-400 produced by Nihon Denshi Co., Ltd.

Examples 1 to 3, Comparative Examples 1 and 2

Example 1

To a mixture of 100 parts by weight of dimethyl terephthalate, 64 parts by weight of ethylene glycol, 0.1 part by weight of hydrated calcium acetate, 28 parts by weight. (5.1 mol % per/the total ester bondage) of an ethylene glycol solution of 5-sodiumsulfo-di(β-Hydroxyethyl)isophthalic acid (35 wt %), 8 parts by weight of polyethylene glycol (7.1 wt %/polymer, number average molecular weight: 3000), 0.05 part by weight of antimony trioxide and 0.13 part by weight of trimethyl phosphate, Irganox 1010 (produced by CIBA-GEIGY Co., Ltd.) as an anti-oxidation product was added to be 1.0 wt %. The mixture was subjected to transesterification in the usual manner. After gradually raising the temperature to 280° C. and reducing the pressure to 0.5 mmHg, the mixture was polymerized under these conditions to obtain a copolymerized polyester ($M_1$).

To a mixture of 100 parts by weight of dimethyl terephthalate, 64 parts by weight of ethylene glycol, 0.1 part by weight of hydrated calcium acetate, 18 parts by weight (3.3 mol %/the total ester bond unit) of ethylene glycol solution of 5-sodiumsulfo-di(β-Hydroxyethyl)isophthalic acid (35 wt %), 4 parts by weight of polyethylene glycol (4.0 wt %/polymer, number average molecular weight: 3000), 0.05 part by weight of antimony trioxide and 0.13 part by weight of trimethyl phosphate, Irganox 1010 (produced by CIBA-GEIGY Co., Ltd.) as an anti-oxidation product was added to be 1 wt %. The mixture was subjected to transesterification in the usual manner. After gradually raising the temperature to 280° C. and reducing the pressure to 0.5 mmHg, the mixture was polymerized under these conditions to obtain a copolymerized polyester ($M_2$).

The above-mentioned copolymerized polyesters were, after being subjected to vacuum drying, melt extruded using 2 units of extruders at 285° C., joined in a layer form in a T die in order to have a layer structure as shown in Table 1 and quenched on a cooling drum, so that an unoriented film wherein the ratio of the thickness of the two layers are 1:1 was obtained. This unoriented film was stretched 3.5 times in the longitudinal direction at 85° C. and further stretched 3.5 times in the lateral direction, followed by heat setting at 210° C. so that a biaxially oriented film having a thickness of 80 μm was obtained. This biaxially oriented film so obtained was used as the photographic support of the invention. In addition, a multilayer color photographic light-sensitive material 1 was prepared by forming a subbing layer and an emulsion layer in that order on the above-mentioned support for photography use obtained and also forming a subbing layer and a backing layer in that order on the opposite side thereof. The characteristic values of aforesaid multilayer color photographic light-sensitive material are as shown in Table 1. Those using a support of the present invention were excellent in adhesive property, curl-recovery property and curling property.

Preparation of Light-sensitive Material

The above photographic support was subjected to corona discharge treatment on both sides at 8 W/m$^2$·min. Then, subbing layer B-1 was formed on one side of the support by coating the following subbing solution B-1 to a dry coating thickness of 0.8 μm, and subbing layer B-2 was formed on the other side of the support by coating the following subbing solution B-2 to a dry coating thickness of 0.8 μm.

| <Subbing Solution B-1> | |
|---|---|
| Latex comprising a copolymer of 30 wt % butyl acrylate, 20 wt % t-butyl acrylate, 25 wt % styrene, and 25 wt % 2-hydroxyethyl acrylate (30 wt % solid content) | 270 g |
| Compound UL-1 | 0.6 g |
| Hexamethylene-1,6-bis(ethylene urea) | 0.8 g |
| Water was added to | 1,000 ml |

| <Subbing Solution B-2> | |
|---|---|
| Latex comprising a copolymer of 40 wt % butyl acrylate, 20 wt % styrene, and 40 wt % glycidyl acrylate (30 wt % solid content) | 270 g |
| Compound UL-1 | 0.6 g |
| Hexamethylene-1,6-bis(ethylene urea) | 0.8 g |
| Water was added to | 1,000 ml |

After subjecting subbing layers B-1 and B-2 to corona discharge treatment at 8 W/m$^2$·min, subbing layer B-3 was formed on subbing layer B-1 by coating the following subbing solution B-3 to a dry coating thickness of 0.1 μm, and subbing layer B-4 having an antistatic property was formed on subbing layer B-2 by coating the following subbing solution B-4 to a dry coating thickness of 0.8 μm.

| <Subbing Solution B-3> | |
|---|---|
| Gelatin | 10 g |
| Compound UL-1 | 0.2 g |
| Compound UL-2 | 0.2 g |
| Compound UL-3 | 0.1 g |
| Silica particles (average particle size: 3 μm) | 0.1 g |
| Water was added to | 1,000 ml |

| <Subbing Solution B-4> | |
|---|---|
| Water-soluble conductive polymer UL-4 | 60 g |
| Latex comprising compound UL-5 (20% solid content) | 80 g |
| Ammonium sulfate | 0.5 g |
| Hardener UL-6 | 12 g |
| Polyethylene glycol (weight average molecular weight: 600) | 6 g |
| Water was added to | 1,000 ml |

The chemical structures of compounds UL-1 to 6 are shown later collectively.

A 25-W/m$^2$·min corona discharge was given to subbing layer B-3, and a 8-W/m$^2$·min corona discharge to subbing layer B-4.

Then, multilayered color photographic material 1 was prepared by forming the following emulsion layer in sequence on subbing layer B-3, and the following backing layer on subbing layer B-4. The amounts of the components in the following backing layers and emulsion layers are per square meter.

| <Backing Layers> | |
|---|---|
| 1st layer: | |
| Gelatin | 4.5 g |
| Sodium-di-(2-ethylhexyl)-sulfosuccinate | 1.0 g |
| Sodium tripolyphosphate | 76 mg |
| Citric acid | 16 mg |
| Carboxyalkyldextran sulfate | 49 mg |
| Vinyl sulfon type hardener | 23 mg |
| 2nd layer (outermost layer) | |
| Gelatin | 1.5 g |
| Polymer beads (average particle size: 3 μm, polymethyl methacrylate) | 24 mg |
| Sodium-d-(2-ethylhexyl)-sulfosuccinate | 15 mg |
| Carboxyalkyldextran sulfate | 12 mg |
| Vinyl sulfon type hardener | 30 mg |
| <Emulsion Layers> | |
| 1st layer: antihalation layer HC | |
| Black colloidal silver | 0.15 g |
| UV absorbent UV-1 | 0.20 g |
| Compound CC-1 | 0.02 g |
| High boiling solvent Oil-1 | 0.20 g |
| High boiling solvent Oil-2 | 0.20 g |
| Gelatin | 1.6 g |
| 2nd layer: intermediate layer IL-1 | |
| Gelatin | 1.3 g |
| 3rd layer: low-speed red-sensitive emulsion layer R-L | |
| Silver iodobromide emulsion (average grain size: 0.3 μm, average iodide content: 2.0 mol %) | 0.4 g |
| Silver iodobromide emulsion (average grain size: 0.4 μm, average iodide content: 8.0 mol %) | 0.3 g |
| Sensitizing dye S-1 | $3.2 \times 10^{-4}$ (mol/mol of silver) |
| Sensitizing dye S-2 | $3.2 \times 10^{-4}$ (mol/mol of silver) |
| Sensitizing dye S-3 | $0.2 \times 10^{-4}$ (mol/mol of silver) |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High boiling solvent Oil-1 | 0.55 g |

-continued

| | |
|---|---|
| Gelatin | 1.0 g |
| 4th layer: high-speed red-sensitive emulsion layer RH | |
| Silver iodobromide emulsion (average grain size: 0.7 μm, average iodide content: 7.5 mol %) | 0.9 g |
| Sensitizing dye S-1 | $1.7 \times 10^{-4}$ (mol/mol of silver) |
| Sensitizing dye S-2 | $1.6 \times 10^{-4}$ (mol/mol of silver) |
| Sensitizing dye S-3 | $0.1 \times 10^{-4}$ (mol/mol of silver) |
| Cyan coupler C-2 | 0.23 g |
| Colored cyan coupler CC-1 | 0.03 g |
| DIR compound D-2 | 0.02 g |
| High boiling solvent Oil-1 | 0.25 9 |
| Gelatin | 1.0 g |
| 5th layer: intermediate layer IL-2 | |
| Gelatin | 0.8 g |
| 6th layer: low-speed green-sensitive emulsion layer GL | |
| Silver iodobromide emulsion (average grain size: 0.4 μm, average iodide content: 8.0 mol %) | 0.6 g |
| Silver iodobromide emulsion (average grain size: 0.3 μm, average iodide content: 2.0 mol %) | 0.2 g |
| Sensitizing dye S-4 | $6.7 \times 10^{-4}$ (mol/mol of silver) |
| Sensitizing dye S-5 | $0.8 \times 10^{-4}$ (mol/mol of silver) |
| Magenta coupler M-1 | 0.17 g |
| Magenta coupler M-2 | 0.43 g |
| Colored magenta coupler CM-1 | 0.10 g |
| DIR compound D-3 | 0.02 g |
| High boiling solvent Oil-2 | 0.7 g |
| Gelatin | 1.0 g |
| 7th layer: high-speed green-sensitive layer GH | |
| Silver iodobromide emulsion (average grain size: 0.7 μm, average iodide content: 7.5 mol %) | 0.9 g |
| Sensitizing dye S-6 | $1.1 \times 10^{-4}$ (mol/mol of silver) |
| Sensitizing dye S-7 | $2.0 \times 10^{-4}$ (mol/mol of silver) |
| Sensitizing dye S-8 | $0.3 \times 10^{-4}$ (mol/mol of silver) |
| Magenta coupler M-1 | 0.30 g |
| Magenta coupler M-2 | 0.13 g |
| Colored magenta coupler CM-1 | 0.04 g |
| DIR compound D-3 | 0.004 g |
| High boiling solvent Oil-2 | 0.35 g |
| Gelatin | 1.0 g |
| 8th layer: yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 g |
| Gelatin | 1.0 g |
| 9th layer: low-speed blue-sensitive emulsion layer BL | |
| Silver iodobromide emulsion (average grain size: 0.3 μm, average iodide content: 2.0 mol %) | 0.25 g |
| Silver iodobromide emulsion (average grain size: 0.4 μm, average iodide content: 8.0 mol %) | 0.25 g |
| Sensitizing dye S-9 | $5.8 \times 10^{-4}$ (mol/mol of silver) |
| Yellow coupler Y-1 | 0.60 g |
| Yellow coupler Y-2 | 0.32 g |
| DIR compound D-1 | 0.003 g |
| DIR compound D-2 | 0.006 g |
| High boiling solvent Oil-2 | 0.18 g |
| Gelatin | 1.3 g |
| 10th layer: high-speed blue-sensitive emulsion layer BH | |
| Silver iodobromide emulsion (average grain size: 0.8 μm, average iodide content: 8.5 mol %) | 0.5 g |
| Sensitizing dye S-10 | $3 \times 10^{-4}$ (mol/mol of silver) |
| Sensitizing dye S-11 | $1.2 \times 10^{-4}$ (mol/mol of silver) |
| Yellow coupler Y-1 | 0.18 g |
| Yellow coupler Y-2 | 0.10 g |
| High boiling solvent Oil-2 | 0.05 g |
| Gelatin | 2.0 g |
| 11th layer: 1st protective layer PRO-1 | |
| Silver iodide (average grain size: 0.08 μm) | 0.3 g |
| UV absorbent UV-1 | 0.07 g |
| UV absorbent UV-2 | 0.10 g |
| Additive HS-1 | 0.20 g |

-continued

| | |
|---|---|
| Additive HS-2 | 0.10 g |
| High boiling solvent Oil-1 | 0.07 g |
| High boiling solvent Oil-3 | 0.07 g |
| Gelatin | 0.80 g |
| 12th layer: 2nd protective layer PRO-2 | |
| Compound A | 0.04 g |
| Compound B | 0.004 g |
| Polymethyl methacrylate (average particle size: 3 μm) | 0.02 g |
| Methyl methacrylate:ethyl methacrylate:methacrylic acid 3:3:4 (weight ratio) copolymer (average particle size: 3 μm) | 0.13 g |
| Gelatin | 0.7 g |

Preparation of Silver Iodobromide Emulsion

The silver iodobromide emulsion used in the 10th layer was prepared by the double-jet method.

Using monodispersed silver iodobromide grains having an average grain size of 0.33 μm and a silver iodide content of 2 mol % as seed grains, the silver iodobromide emulsion was prepared by means of a double jet method.

While stirring the following solution G-1 under conditions of 70° C., pAg 7.8 and pH 7.0, 0.34 mol of the seed emulsion was added thereto.

(Formation of Inner High Iodide Content Phase-Core Phase)

Then, the following solutions H-1 and S-1 were added, while keeping the flow ratio at 1:1, in 86 minutes at an accelerated flow rate (the final flow rate was 3.6 times the initial flow rate).

(Formation of Outer Low Iodide Content Phase-Shell Phase)

Subsequently, the following solutions H-2 and S-2 were added at a flow ratio of 1:1 in 65 minutes, under conditions of pAg 10.1 and pH 6.0, while accelerating the flow rate so as to make the final flow rate 5.2 times the initial flow rate.

During grain formation, the pAg and pH were controlled with an aqueous solution of potassium bromide and an aqueous solution of 56% acetic acid. The resulting silver halide grains were desalted according to the usual flocculation method and redispersed with the addition of gelatin to give an emulsion, which was then adjusted to pH 5.8 and pAg 8.06 at 40° C.

The emulsion thus obtained was a monodispersed emulsion comprising octahedral silver iodobromide grains having an average grain size of 0.80 μm, a grain size distribution extent of 12.4% and a silver iodide content of 8.5 mol %.

| | |
|---|---|
| Solution G-1 | |
| Osein gelatin | 100.0 g |
| Compound-I | 25.0 ml |
| 28% aqueous ammonia | 440.0 ml |
| 56% aqueous acetic acid solution | 660.0 ml |
| Water was added to | 5,000.0 ml |
| Solution H-1 | |
| Osein gelatin | 82.4 g |

-continued

| | |
|---|---|
| Potassium bromide | 151.6 g |
| Potassium iodide | 90.6 g |
| Water was added to | 1,030.5 ml |
| Solution S-1 | |
| Silver nitrate | 309.2 g |
| 28% Aqueous ammonia | equivalent |
| Water was added to | 1,030.5 ml |
| Solution H-2 | |
| Osein gelatin | 302.1 g |
| Potassium bromide | 770.0 g |
| Potassium iodide | 33.2 g |
| Water was added to | 3,776.8 ml |
| Solution S-2 | |
| Silver nitrate | 1,133.0 g |
| 28% Aqueous ammonia | equivalent |
| Water was added to | 3,776.8 ml |

The silver iodobromide emulsions used in the emulsion layers other than the 10th layer were prepared in the same way so as to give different average grain sizes and silver iodide contents, by varying the average grain size of seed grains, temperature, pAg, pH, flow rate, addition time and halide composition.

Each of these emulsions, which were monodispersed emulsions comprised core/shell type grains having a distribution extent not more than 20%, was optimally chemically ripened in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added thereto.

In addition to the above components, photographic light-sensitive materials 1 to 5 contained compounds Su-1 and Su-2, a viscosity regulator, hardeners H-1 and H-2, stabilizer ST-1, antifoggants AF-1 and AF-2 (weight average molecular weights were 10,000 and 1,100,000, respectively), dyes AI-1 and AI-2, and compound DI-1 (9.4 mg/m$^2$).

The chemical structures of the compounds used in the above light-sensitive materials were as follows:

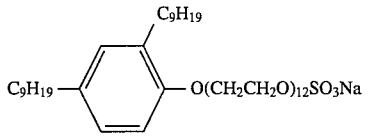

UL-1

-continued
UL-2
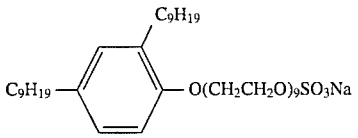
UL-4
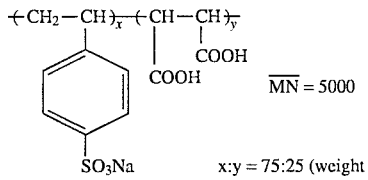
$\overline{MN} = 5000$
x:y = 75:25 (weight ratio)
UL-5
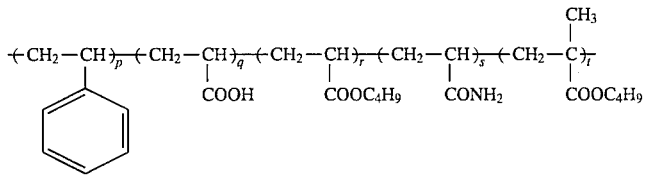
p:q:r:s:t = 40:5:10:5:40 (weight ratio)
a mixture of
UL-6
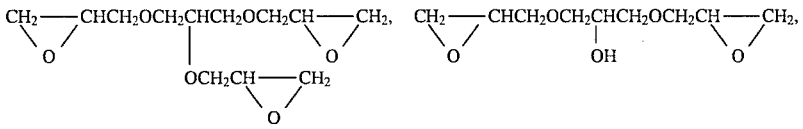
and
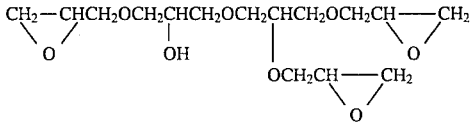
C-1
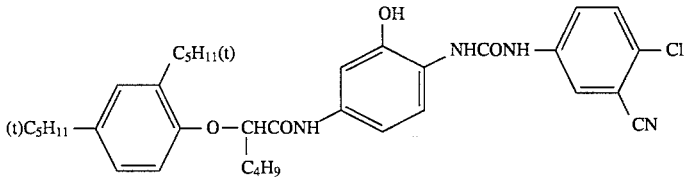
C-2
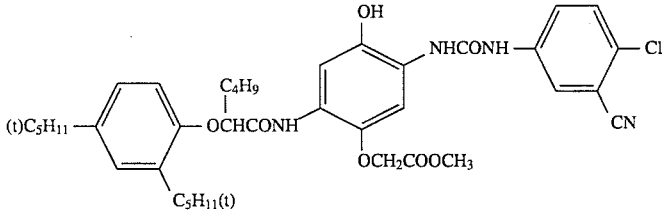
M-1
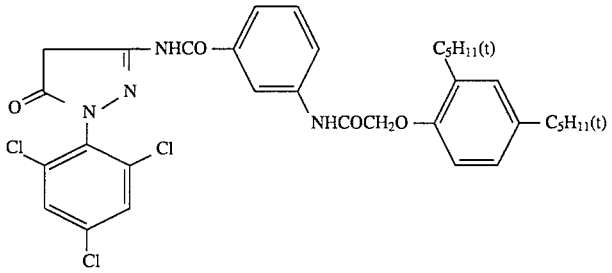

-continued
M-2
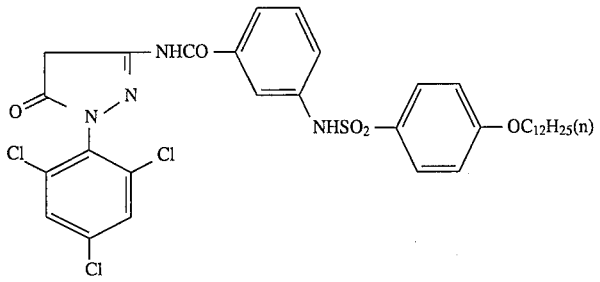
Y-1
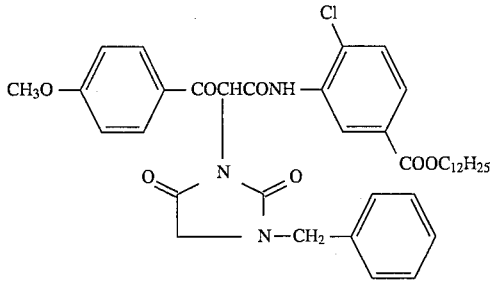
Y-2
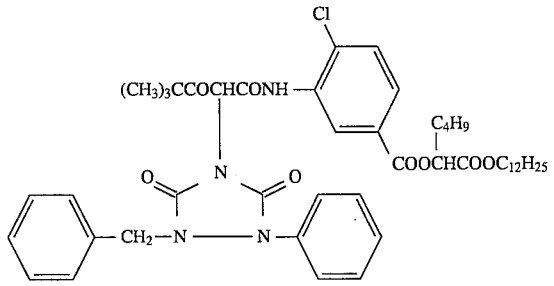
CC-1
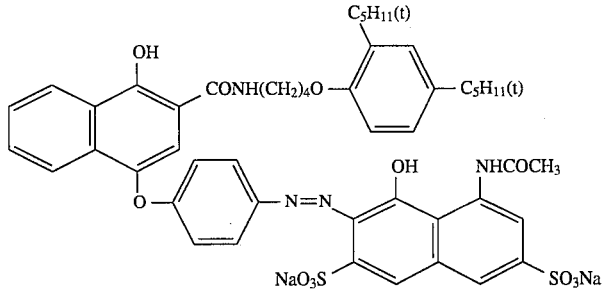
CM-1
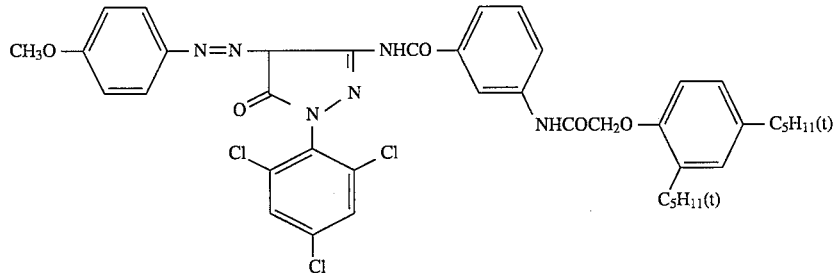

-continued
D-1
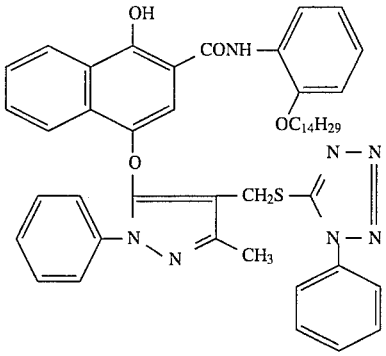
D-2
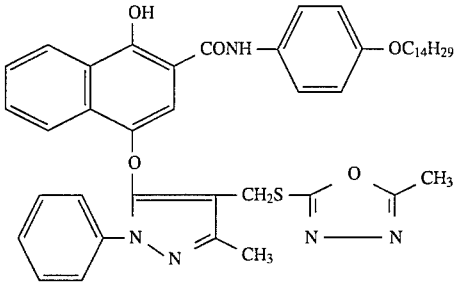
D-3
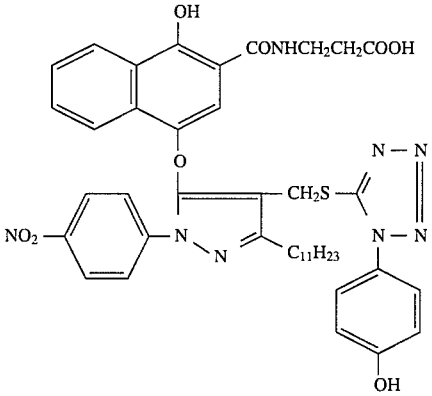
UV-1
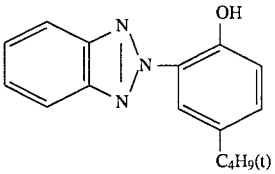
UV-2
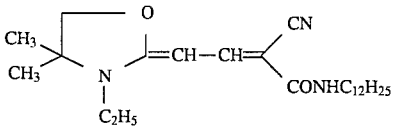
S-1
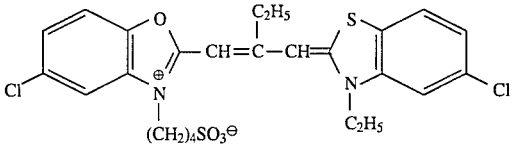
S-2
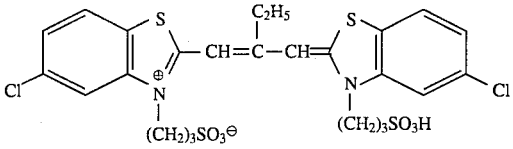

-continued
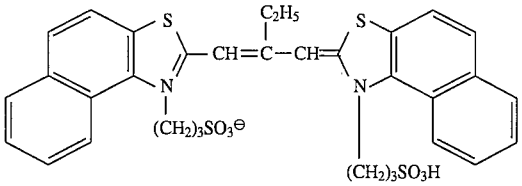
S-3
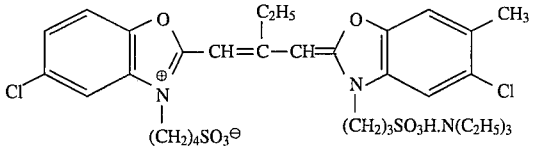
S-4
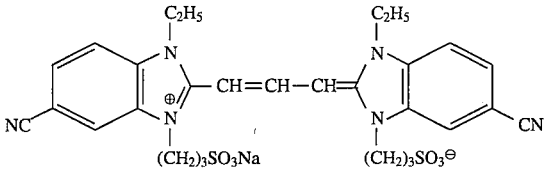
S-5
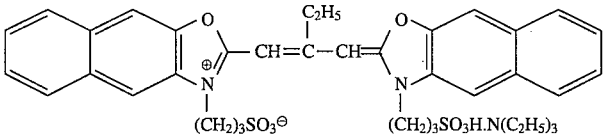
S-6
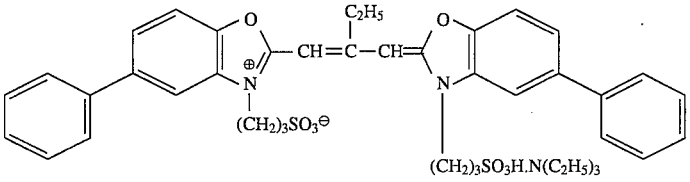
S-7
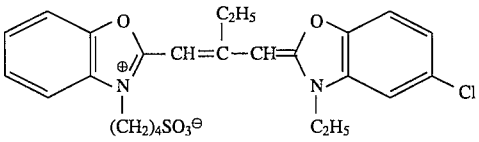
S-8
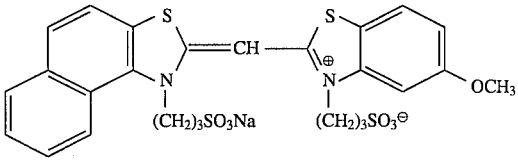
S-9
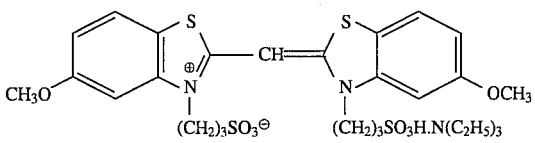
S-10
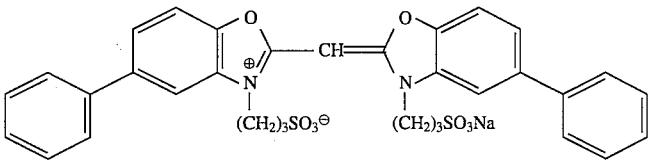
S-11
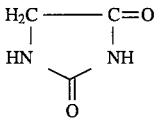
HS-1

-continued
HS-2
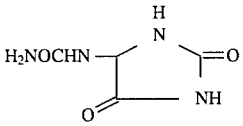
SC-1
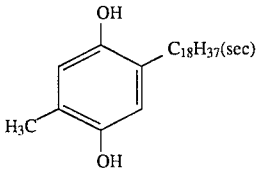
and
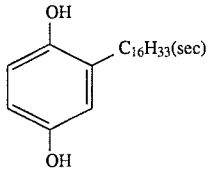
(mixture of 2:3)
Oil-1
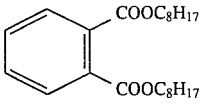
Oil-2
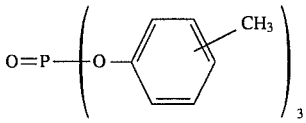
Oil-3
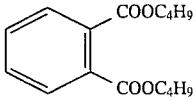
H-1
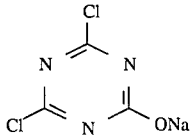
H-2
$(CH_2{=}CHSO_2CH_2)_2O$
SU-1
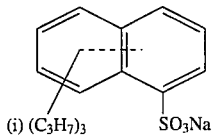
SU-2
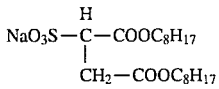
Compound A
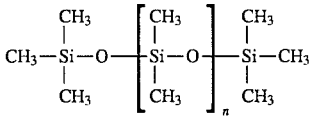
weight average molecular weight = 30,000
Compound B
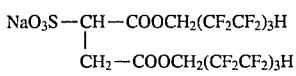
DI-1
(A mixture of the following three components)
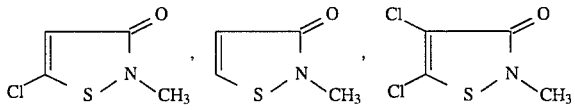
Component A Component B Component C
component A:component B:component C: = 50:46:4 (mole ratio)

-continued

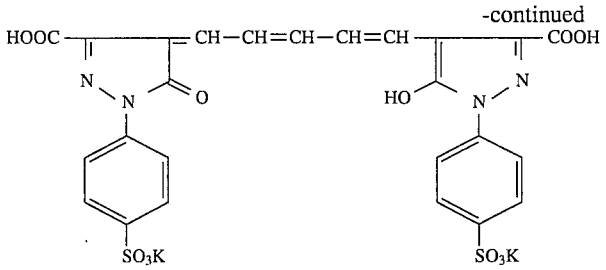

AI-1

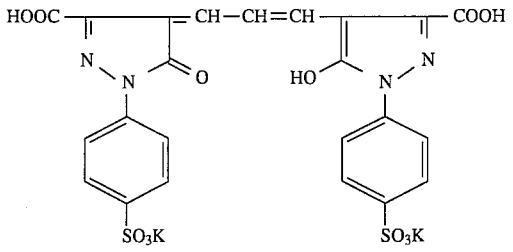

AI-2

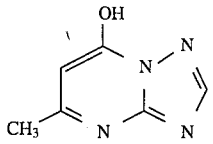

ST-1

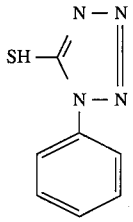

AF-1

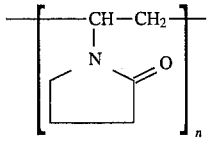

AF-2

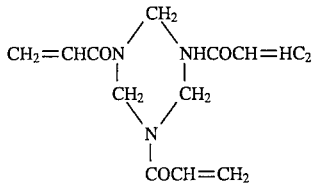

UL-3

(Examples 2 through 5, Comparative Examples 1 through 3)

Copolymer polyesters ($M_3$) through ($M_9$) were prepared in the same manner as in Example 1, except that an ethylene glycol solution of 5-sodiumsulfo-di(β-hydroxyethyl)isophthalic acid (35 wt %) and polyethylene glycol (number average molecular weight: 3000) were changed as shown in Table 2. In addition, multilayer color photographic light-sensitive materials 2 through 7 and 10 were prepared in the same manner as in Example 1, except that the layer structure and the thickness ratio of the support were varied as shown in Table 1 using the polyesters and polyethylene terephthalates (the intrinsic viscosity was 0.65) as shown in Table 2. The characteristic values of the aforesaid multilayer color photographic light-sensitive materials are shown in Table 1. As is seen from Table 1, those using the support of the present invention were excellent in adhesive property, curl-recovery property and curling property.

(Examples 6 through 8)

Multi-colored photographic light-sensitive materials 8, 9 and 11 were prepared in the same manner as in Example 1, except that the number of extruders was increased to 3 units, and the layer structure and the thickness ratio of the support were varied as shown in Table 1 using the polyesters and polyethylene terephthalates (the intrinsic viscosity was 0.65) as shown in Table 2. The characteristic values of the aforesaid multilayer color photographic light-sensitive materials are shown in Table 1. As is seen from Table 1, those using the support of the present invention were excellent in adhesive property, curl-recovery property and curling property.

Example 9

Copolymerization polyesters ($M_{10}$) and ($M_{11}$) were prepared in the same manner as in Example 1 except that polyethyleneoxydicarboxylic acid (the number average molecular weight was 5000) was used in place of polyethyleneglycol as shown in Table 2. A multilayer color photographic light-sensitive material 12 was prepared in the same manner as in Example 1, except that the above-obtained polyesters were used and the layer structure and the thickness ratio of the support were varied as shown in Table 1. The characteristic values of the aforesaid multilayer color photographic light-sensitive material are shown in Table 1. As is seen from Table 1, those using the support of the present invention were excellent in adhesive property, curl-recovery property and curling property.

TABLE 1

| Examples | Layer structure | Thickness ratio | Difference in copolymer component content between each adjacent layer: ΔSIP (mol %/total ester bonds) | ΔPEG (wt %/total weight) | Adhesive property | Curl-recovery property | Curling property | Multilayer photographic light-sensitive material |
|---|---|---|---|---|---|---|---|---|
| Ex. 1 | $M_1$ | 1 | 1.9 | 3.1 | ○ | 95 | Δ | 1 |
| | $M_2$ | 1 | | | | | | |
| Ex. 2 | $M_1$ | 1 | 1.8 | 6.0 | ○ | 90 | ○ | 2 |
| | $M_3$ | 1 | | | | | | |
| Ex. 3 | $M_1$ | 1 | 5.5 | 3.1 | ○ | 80 | ○ | 3 |
| | $M_5$ | 1 | | | | | | |
| Comp. 1 | $M_1$ | 1 | 5.9 | 3.1 | X | 75 | ○ | 4 |
| | $M_6$ | 1 | | | | | | |
| Ex. 4 | $M_1$ | 1 | 5.5 | 6.0 | ○ | 70 | ○ | 5 |
| | $M_7$ | 1 | | | | | | |
| Comp. 2 | $M_1$ | 1 | 5.9 | 6.5 | X | 70 | ○ | 6 |
| | $M_8$ | 1 | | | | | | |
| Ex. 5 | $M_2$ | 1 | 1.9 | 4.0 | ○ | 8U | Δ | 7 |
| | $M_9$ | 1 | | | | | | |
| Ex. 6 | $M_1$ | 1 | 1.9 | 3.1 | ○ | 95 | ○ | 8 |
| | $M_2$ | 2 | | | | | | |
| | $M_1$ | 3 | 1.9 | 3.1 | | | | |
| Ex. 7 | $M_1$ | 1 | 1.9 | 3.1 | ○ | 85 | Δ | 9 |
| | $M_2$ | 1 | | | | | | |
| | $M_9$ | 1 | 1.9 | 4.0 | | | | |
| Comp. 3 | $M_1$ | 1 | 6.0 | 7.1 | X | 80 | ○ | 10 |
| | P* | 2 | | | | | | |
| | $M_1$ | 3 | 6.0 | 7.1 | | | | |
| Ex. 8 | $M_2$ | 1 | 4.1 | 4.0 | ○ | 65 | ○ | 11 |
| | P* | 2 | | | | | | |
| | $M_2$ | 3 | 4.1 | 4.0 | | | | |
| Ex. 9 | $M_{10}$ | 1 | 3.4 | 4.6 | ○ | 95 | ○ | 12 |
| | $M_{11}$ | 1 | | | | | | |

*P; Layer composed of polyethylene terephthalate
Ex.: Example
Comp.: Comparative

TABLE 2

| Copolymer polyester | Polyalkylene glycol: Added amount (part by weight) | Polyalkylene glycol: Copolymerization ratio (weight %/polymer) | 35 wt % ethylene glycol solution of an aromatic dicarboxylic acid containing a metal sulfonate group: Added amount (part by weight) | 35 wt % ethylene glycol solution of an aromatic dicarboxylic acid containing a metal sulfonate group: Copolymerization ratio (mol %/all acid components) |
|---|---|---|---|---|
| $M_1$ | 8 | 7.1 | 28 | 5.1 |
| $M_2$ | 4 | 4.0 | 18 | 3.3 |
| $M_3$ | 1 | 1.1 | 18 | 3.3 |
| $M_4$ | 0.6 | 0.6 | 18 | 3.3 |
| $M_5$ | 4 | 4.0 | 2 | 0.4 |
| $M_6$ | 4 | 4.0 | 1 | 0.1 |
| $M_7$ | 1 | 1.1 | 2 | 0.4 |
| $M_8$ | 0.6 | 0.6 | 1 | 0.1 |
| $M_9$ | 0 | 0 | 26 | 4.7 |
| $M_{10}$ | 8 | 7.1 | 28 | 5.0 |
| $M_{11}$ | 3 | 2.5 | 11 | 2.0 |

What is claimed is:

1. A silver halide photographic light sensitive material comprising a support and provided thereon, a silver halide emulsion layer, said support being comprised of at least two polyester layers comprising a first layer containing a first polyester and a second layer containing a second polyester adjacent to the first layer, the first polyester and second polyester each comprising a first monomer unit from a polyalkylene glycol and a second monomer unit from an aromatic dicarboxylic acid having a metal sulfonate group, wherein the difference between the second monomer unit content of the first polyester and that of the second polyester, ΔSIP is 1 to 4.5 mol %, the second monomer unit content being expressed based on the total content of monomer units from dicarboxylic acids contained in the first polyester and the second polyester.

2. The material of claim 1, wherein the difference between the content of the first monomer unit of the first polyester and that of the second polyester, ΔPEG is not more than 6.0% by weight.

3. The material of claim 2, wherein said ΔPEG is 3 to 5.0% by weight.

4. The material of claim 2, wherein said ΔSIP and said ΔPEG is not 0 simultaneously.

5. The material of claim 1, wherein said first polyester further has a monomer unit from an aliphatic dicarboxylic acid.

6. The material of claim 1, wherein said first polyester contains said second monomer unit from an aromatic dicarboxylic acid having a metal sulfonate group in an amount of 2 to 7 mol %.

7. The material of claim 1, wherein said aromatic dicarboxylic acid having a metal sulfonate group is selected from the group consisting of 5-sodiumsulfoisophthalic acid, 2-sodiumsulfoisophthalic acid, 4-sodiumsulfoisophthalic acid, 4-sodiumsulfo-2,6-naphthalenedicarboxylic acid and ester derivatives thereof.

8. The material of claim 1, wherein said polyalkylene glycol has a number average molecular weight of 300 to 20000 and is represented by the following formula (a);

formula (a)

$$H—(O—CH_2CH_2)_n—OH,$$

9. The material of claim 1, having a thickness of 30 to 200 μm.

* * * * *